US006923341B2

(12) United States Patent
Smith

(10) Patent No.: US 6,923,341 B2
(45) Date of Patent: Aug. 2, 2005

(54) DRAIN-BACK SNAP-ON POUR SPOUT FITMENT CLOSURE

(75) Inventor: Robert J. Smith, Edinboro, PA (US)

(73) Assignee: Erie County Plastics Corporation, Corry, PA (US)

( * ) Notice: Subject to any disclaimer, the term of this patent is extended or adjusted under 35 U.S.C. 154(b) by 25 days.

(21) Appl. No.: 10/693,268

(22) Filed: Oct. 24, 2003

(65) Prior Publication Data

US 2005/0087548 A1 Apr. 28, 2005

(51) Int. Cl.[7] ..... B67D 1/16
(52) U.S. Cl. ..... 222/109; 222/153.14; 222/570
(58) Field of Search ..... 222/39, 109, 153.14, 222/424, 570

(56) References Cited

U.S. PATENT DOCUMENTS

| | | | |
|---|---|---|---|
| 2,601,040 | A | 6/1952 | Livingstone |
| 2,743,844 | A | 5/1956 | Livingstone |
| 2,763,402 | A | 9/1956 | Livingstone |
| 2,763,403 | A | 9/1956 | Livingstone |
| 2,808,964 | A | 10/1957 | Radtke |
| 3,369,710 | A | 2/1968 | Lucas |
| 4,078,700 | A | 3/1978 | Hidding |
| 4,128,189 | A | 12/1978 | Baxter |
| 4,550,862 | A | 11/1985 | Barker et al. |
| 4,671,421 | A | 6/1987 | Reiber et al. |
| 4,696,416 | A | 9/1987 | Muckenfuhs et al. |
| 4,706,829 | A | 11/1987 | Li |
| 4,773,560 | A | 9/1988 | Kittscher |
| 4,830,234 | A | 5/1989 | Odet |
| 4,836,419 | A | 6/1989 | Metz et al. |
| 4,863,067 | A | 9/1989 | Krall |
| 4,890,770 | A | 1/1990 | Haga et al. |
| 4,917,268 | A | 4/1990 | Campbell et al. |
| 4,917,269 | A | 4/1990 | Fuchs et al. |
| 4,917,270 | A | 4/1990 | Simon |
| 4,974,749 | A | 12/1990 | Mon |
| 4,981,239 | A | 1/1991 | Cappel et al. |
| 4,984,714 | A | 1/1991 | Sledge |
| 4,993,605 | A | 2/1991 | Del'Re |
| 5,058,772 | A | 10/1991 | Moore et al. |
| 5,108,009 | A | 4/1992 | Davidson et al. |
| 5,114,659 | A | 5/1992 | Krall |
| 5,131,566 | A | 7/1992 | Bavegems |
| 5,207,356 | A | 5/1993 | Krall |
| 5,234,130 | A | 8/1993 | Benioff et al. |

(Continued)

*Primary Examiner*—Joseph A. Kaufman
(74) *Attorney, Agent, or Firm*—Blynn L. Shideler; Krisanne Shideler; BLK Law Group

(57) ABSTRACT

A snap on, drain back fitment closure for a container, wherein the drain back pour spout fitment has a snap fit structure overlaying a container or bottle neck finish and which may be secured thereto with adhesives. The snap fit structure has an outer annular skirt with internal, radial inwardly facing beads engaging a radial outwardly facing surface of the bottle finish. Spaced from the outer annular skirt by a horizontal upper flange, the spout fitment includes an inner annular skirt with internal threads on the fitment to receive an externally threaded closure. The closure has a plug seal above the threads engaging the upper flange of the fitment. Further the closure has a radial outwardly facing latch engaging a radial inwardly facing interfering projection on the fitment forming a child safety feature for the fitment closure.

11 Claims, 3 Drawing Sheets

U.S. PATENT DOCUMENTS

| | | | | |
|---|---|---|---|---|
| 5,251,788 | A | 10/1993 | Moore | |
| 5,431,306 | A | 7/1995 | Reid | |
| 5,462,202 | A | 10/1995 | Haffner et al. | |
| 5,566,862 | A | 10/1996 | Haffner et al. | |
| 5,597,090 | A | 1/1997 | Leahy | |
| 5,603,787 | A | 2/1997 | Reid | |
| 5,794,803 | A | 8/1998 | Sprick | |
| 5,855,299 | A | 1/1999 | Arnold et al. | |
| 5,941,422 | A | 8/1999 | Struble | |
| 6,032,829 | A | 3/2000 | Geisinger et al. | |
| 6,123,231 | A | 9/2000 | Geisinger | |
| 6,209,762 | B1 | 4/2001 | Haffner et al. | |
| 6,223,945 | B1 | 5/2001 | Giblin et al. | |
| 6,223,946 | B1 | 5/2001 | Geisinger et al. | |
| 6,279,789 | B1 | 8/2001 | Krall | |
| 6,375,041 | B1 | 4/2002 | Klima et al. | |
| 6,398,076 | B1 | 6/2002 | Giblin et al. | |
| 6,431,401 | B1 | 8/2002 | Giblin et al. | |
| 6,464,106 | B1 | 10/2002 | Giblin et al. | |
| 2004/0026450 | A1 * | 2/2004 | Rohr et al. | 222/109 |

* cited by examiner

DRAIN-BACK SNAP-ON POUR SPOUT FITMENT CLOSURE

BACKGROUND OF THE INVENTION

1. Field of the Invention

The present invention relates to drain-back pour spout closures for containers and more specifically to drain-back snap-on pour spout fitment closures for containers with child safety features.

2. Background of the Invention

Drain-back pour spouts are very well known in the art. One class of drain back pour spouts is form the spout as a fitment attached to a separate container with a separate closure for the fitment. One subset of this class is those devices having the closure attached to the bottle and another subset is having the closure attached to the fitment or pour spout. A second class of drain-back pour spouts is one in which the spout is formed integral with the container, in other words the spout forms a specialized finish (e.g. neck finish) for the container. In this class the closure is always connected to the container since there is no separate fitment. A review of the representative prior art will further clarify the state of the art.

U.S. Pat. Nos. 6,464,106 and 6,431,401, both assigned to Lever Brothers Company, disclose a drain back converging nozzle spout fitment secured to a container opening with an external ridge engaging an internal ring on the container. A closure or cap is threaded onto the container over the fitment to close the container opening.

U.S. Pat. No. 6,398,076, assigned to Unilever Home& Personal Care USA, discloses a variety of drain back, snap on, cylindrical nozzle, pour spout fitments with inside of the spout (also called the gutter or apron) not extending below outer connecting flange of the fitment.

U.S. Pat. No. 6,375,041 discloses a container with an integral (or separate) drain back, converging nozzle neck finish (or fitment if it is separate) with a cap or closure threaded onto the spout portion, wherein the cap includes a reservoir for holding a concentrated product, e.g. detergent. If separate the fitment would be apparently press fit or welded to the container opening.

U.S. Pat. No. 6,279,789, assigned to Owens-Brockway Plastics Products, Inc., discloses a variety of spout (both integral with the container and as separate fitments) and closure configurations with the cap or closure including a disk with a metalized underlayer for induction welding to associated structure. One embodiment shown in FIG. 3 includes a fitment secured within the container finish with the cap threaded to the fitment with internal threads on the fitment.

U.S. Pat. No. 6,223,946, assigned to Owens-Illinois Closures, Inc., discloses a bottle with integral drain back spout and closure configuration with threads formed on the neck of the bottle engaging the closure directly.

U.S. Pat. No. 6,223,945, assigned Lever Brothers Company, discloses a specific three layer bottle composition on which a similar fitment and closure is snap fit. The fitment and closure U.S. Pat. No. 6,464,106 discussed above.

U.S. Pat. No. 6,209,762, assigned to Owens-Illinois Closures, Inc., discloses a bottle with snap in drain back spout configuration having a projecting lug and receiving slot for positioning of the fitment.

U.S. Pat. No. 6,123,231, assigned to Owens-Brockway Plastics Products, Inc., discloses a one piece bottle with integral drain back spout configuration.

U.S. Pat. No. 6,032,829, assigned to Owens-Illinois Closures, Inc., discloses a bottle with integral spout and closure configuration with threads formed on the neck of the bottle engaging the closure directly.

U.S. Pat. No. 5,941,422, assigned to Owens-Brockway Plastics Products, Inc. discloses a bottle, drain back spout fitment and closure configuration with a unique bottle neck finish having a radial inwardly annular wall and an axial wall extending upwardly and away from the inner extending wall. The fitment has a depending apron extending over the neck finish and welded thereto.

U.S. Pat. No. 5,855,299, assigned to Graham Packaging Corporation, discloses a drain back spout fitment configuration with an inner radial outwardly facing annular bead engaging a shoulder of the bottle neck.

U.S. Pat. No. 5,794,803, assigned to Rexam closures, Inc., discloses a drain back spout fitment configuration with a cap threaded onto threads of the bottle and with a child safety lock mechanism between the bottle and the cap, wherein the latch release on the cap is biased in a radial direction away from the bottle.

U.S. Pat. No. 5,603,787, assigned to Innovative Molding Inc., discloses a method of assembly of a bottle with a pour back spout configuration with an annular solid wall and the pour back feature being formed in an opening in the outer wall or trough. The method includes ultrasonic welding of the pour spout fitment to the container.

U.S. Pat. No. 5,597,090 discloses a spout fitment configuration with a "v" shaped notch at the terminal end. The cap is threaded to the bottle over the spout fitment.

U.S. Pat. Nos. 5,566,862 and 5,462,202, both assigned to Owens-Illinois Plastics Products, Inc. disclose a drain back spout fitment configurations with an annular solid wall and the pour back feature being formed in an extended opening in the outer wall. The closure is threaded onto the bottle over the fitment.

U.S. Pat. No. 5,431,306, assigned to Innovative Molding Inc., discloses a drain back spout fitment configuration with an annular top flange bonded to an upper end of the bottle neck finish. The closure is threaded to the fitment with external threads on the closure engaging internal threads on the fitment below a sealing portion there-between.

U.S. Pat. No. 5,251,788, assigned to Phoenix Closures, Inc., discloses a bottle, drain back frusto-conical or converging nozzle spout fitment and cap configuration. The bottle includes a threaded neck to receive the threaded spout. The cap is threaded to an upper portion of the annular wall.

U.S. Pat. No. 5,234,130, assigned to Manhattan Products, discloses a bottle, drain back pour spout fitment and cap configuration. The bottle includes an internal neck finish recess to engage a retaining member on the spout and allow the cap to seal against the bottle finish.

U.S. Pat. No. 5,207,356, assigned to Owens-Illinois Plastics Products, Inc., discloses a bottle with an integral spout and cap configuration.

U.S. Pat. No. 5,131,566, assigned to Proctor & Gamble Company, discloses a flowable package assembly with a "refill facilitating" drain back spout having piecing serrations on the spout. An associated closure is not disclosed.

U.S. Pat. No. 5,114,659, assigned to Owens-Illinois Plastic Products Inc., discloses a method of making a one piece bottle and integral drain back pour spout.

U.S. Pat. No. 5,108,009, assigned to Lever Brothers Company, discloses a bottle, drain back spout fitment and cap configuration with the cap screwed onto the container.

U.S. Pat. No. 5,058,772, assigned to Phoenix Closures, discloses a bottle, drain back pour spout fitment and cap configuration. The spout fitment is threaded to the bottle and includes external threads on an upper portion thereof for the cap to be threaded onto.

U.S. Pat. No. 4,993,605, assigned to Colgate Palmolive Co., discloses a bottle, drain back pour spout fitment and cap configuration wherein the cap engages the container (e.g. threaded bottle neck) to urge the spout fitment into sealing engagement with the neck finish.

U.S. Pat. No. 4,984,714 discloses a bottle, spout fitment and cap configuration with the cap threaded to the bottle.

U.S. Pat. No. 4,981,239, assigned to Proctor & Gamble Company, discloses a bottle with an integral spout and cap configuration.

U.S. Pat. No. 4,974,749, assigned to Colgate Palmolive Co., discloses a bottle, drain back pour spout fitment and cap configuration with a threaded bottle neck finish that the cap threads onto.

U.S. Pat. No. 4,917,270 discloses a bottle, drain back pour spout fitment and cap configuration with a threaded bottle neck finish that the cap threads onto.

U.S. Pat. No. 4,917,269, assigned to Owens-Illinois Plastics Products, Inc., discloses a bottle with an integral spout and cap configuration.

U.S. Pat. No. 4,917,268, assigned to The Clorox Company, discloses a bottle, drain back pour spout fitment and cap configuration with a special interlocking and centering feature between the bottle neck finish and the fitment. The cap is threaded onto the bottle.

U.S. Pat. No. 4,890,770 discloses a unique bottle spout and cap configuration with an inside drainage passage between the cap and the outside of the spout.

U.S. Pat. No. 4,863,067, assigned to Owens-Illinois Plastics Products, Inc. discloses a bottle with an integral spout and cap configuration.

U.S. Pat. No. 4,836,419 discloses a drain back spout fitment and cap configuration with a drain in the apron or floor portion adjacent the spout. The drain back opening has a blocking mechanism to selectively block the opening. The cap is threaded to external threads on the fitment on an apron around the bottle opening.

U.S. Pat. No. 4,830,234 discloses a bottle, drain back pour spout fitment and cap configuration with a threaded bottle neck finish that the cap threads onto.

U.S. Pat. No. 4,773,560 discloses a bottle, drain back pour spout fitment and cap configuration with a threaded bottle neck finish that the cap threads onto.

U.S. Pat. No. 4,706,829, assigned to Owens-Illinois Closure, Inc., discloses a bottle, drain back pour spout fitment and cap configuration with a threaded bottle neck finish that the cap threads onto.

U.S. Pat. No. 4,696,416, assigned to Proctor & Gamble, discloses a bottle, a drain back spout fitment threaded to the container, and cap threaded to an upper portion of the fitment, with a drip accumulator structure extending down from the drain hole.

U.S. Pat. No. 4,671,421 discloses a bottle, drain back spout fitment and cap configuration with the spout fitment engaging the inner surface of the container interconnecting the spout fitment with the bottle.

Expired U.S. Pat. Nos. 4,550,862, 4,128,189, 4,078,700, 3,369,710, 2,808,964, 2,763,403, 2,763,402, 2,743,844, and 2,601,040 also show a variety of drain back spout configurations similar to those discussed above.

There remains a need in the art to provide a drain-back snap-on pour spout fitment closure for containers with child safety features. It is the object of the present invention to improve upon the prior art and address this need.

SUMMARY OF THE INVENTION

The objects of the present invention are achieved with a drain-back snap-on pour spout fitment closures for containers with child safety features according to the present invention. The proposed design includes a drain back pour spout fitment with a snap fit structure overlaying a container or bottle neck finish and which may be secured thereto with adhesives. The snap fit structure has an outer annular skirt with internal, radial inwardly facing beads engaging a radial outwardly facing surface of the bottle finish. Spaced from the outer annular skirt by a horizontal upper flange, the spout fitment includes an inner annular skirt with internal threads on the fitment to receive an externally threaded closure. The closure has a plug seal above the threads engaging the upper flange of the fitment. Further the closure has a radial outwardly facing latch engaging a radial inwardly facing interfering projection on the fitment forming a child safety feature for the closure.

These and other advantages of the present invention will be clarified in the detailed description of the preferred embodiment taken together with the attached drawings.

BRIEF DESCRIPTION OF THE DRAWING(S)

DESCRIPTION OF THE PREFERRED EMBODIMENTS

Figure 7:
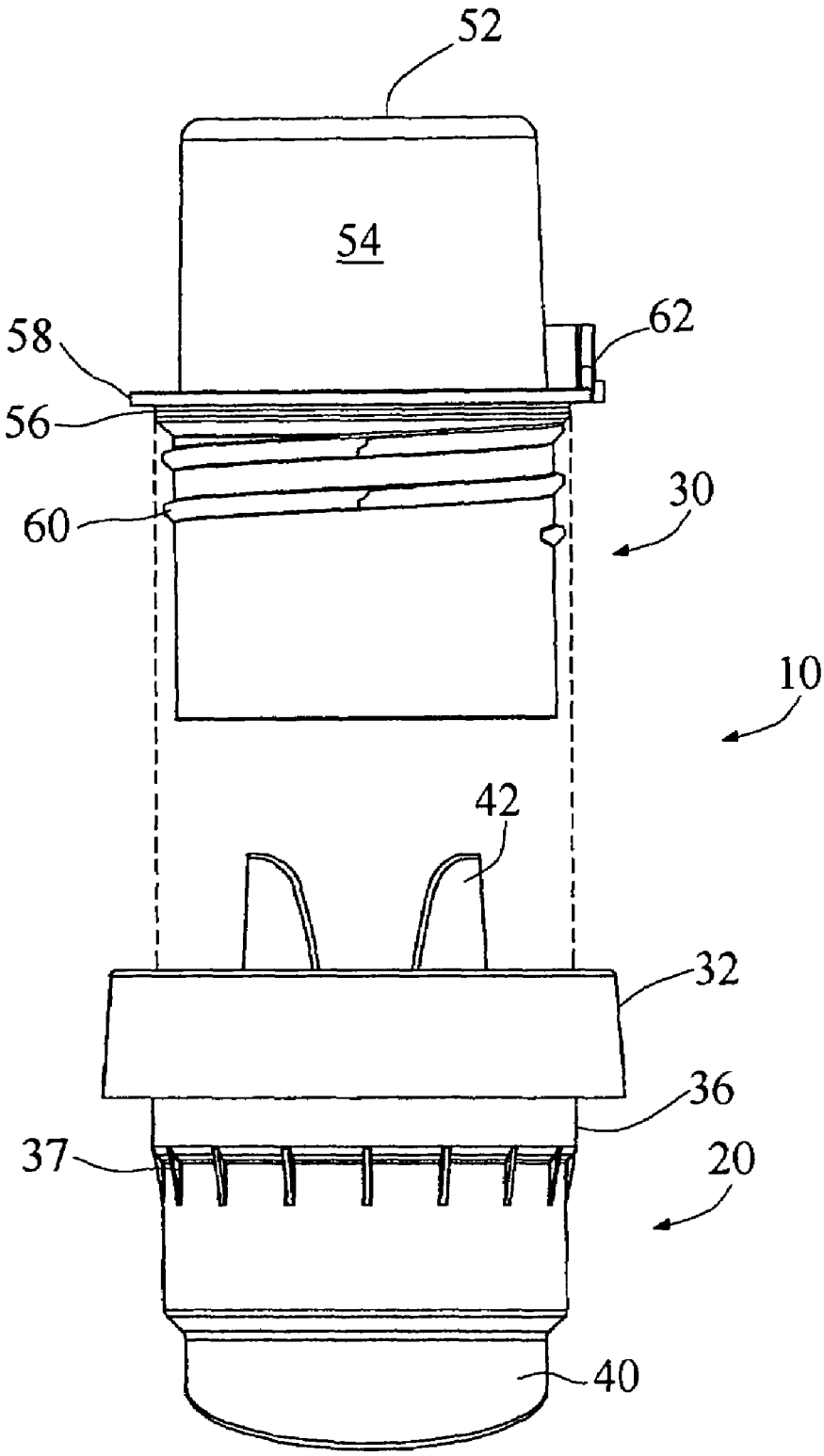
FIG. 7 is an exploded elevational view of the fitment and closure according to the present invention.

A drain-back snap-on pour spout fitment closure 10 for containers or bottles (not shown) with child safety features according to the present invention is shown together in FIG. 7. The bottle or container structure is well known in the art as evidenced in the prior art discussed in detail above and incorporated herein by reference. The fitment closure 10 includes a drain back pour spout fitment 20 and a closure 30 attached thereto. The term "fitment closure" within the meaning of this application is that the fitment includes the closure thereon, as opposed to the alternative constructions of the prior art in which the closure is attached directly to the bottle or container.

Figure 2:
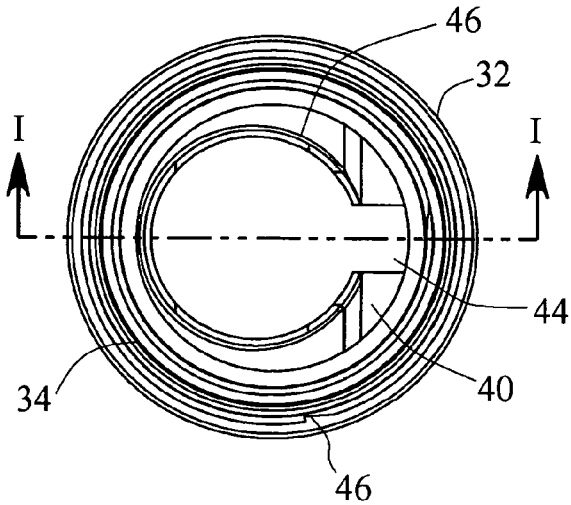
FIG. 2 is a top plan view of the drain back pour spout fitment illustrated in FIG. 1.
Figure 3:
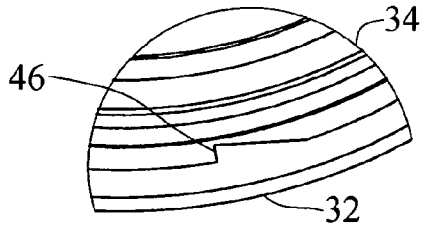
FIG. 3 is an enlarged view of the child safety recess in the fitment of FIGS. 1–2.
Figure 1:
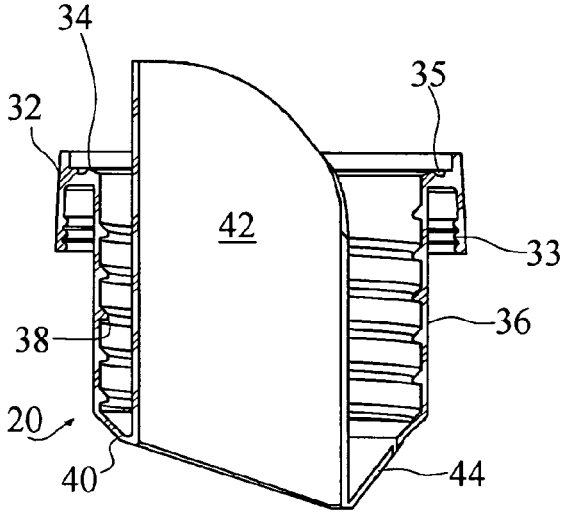
FIG. 1 is a sectional view taken along line I—I of FIG. 2 of a snap on drain back pour spout fitment according to the present invention.

The drain back pour spout fitment 20 is illustrated in detail in FIGS. 1–3. The fitment 20 is a one piece injection molded polypropylene component. The fitment includes a snap fit structure overlaying a container or bottle neck finish and which may be secured thereto with adhesives. The snap fit structure has an outer annular skirt 32 with internal, radial inwardly facing beads 33 engaging a radial outwardly facing surface of the bottle finish (not shown). A horizontal upper flange 34 extends inwardly from the outer annular skirt 32 below a top surface thereof and includes groove 35. The spout fitment 20 includes an inner annular skirt 36 (which may be formed with an offset and supporting rib 37 or gussets as shown in the embodiment of FIG. 7) with internal threads 38 on the fitment 20 to receive the externally threaded closure 30. The fitment 20 includes an angled apron 40 at a lower surface of the inner annular skirt 36 and extending to a central generally cylindrical pour spout 42 with the pour spout 42 extending from the apron 40 to a position above the top surface of the outer annular skirt 32. The spout 42 has an open side aligned with an opening 44 in a lowermost portion of the apron 40 to form the drain back feature. Finally the fitment 20 includes an inwardly projecting ramp shaped projection 46 generally on an inner surface of the outer annular skirt 32, with the projection 46 forming half of a child safety feature as will discussed below.

Figure 4:
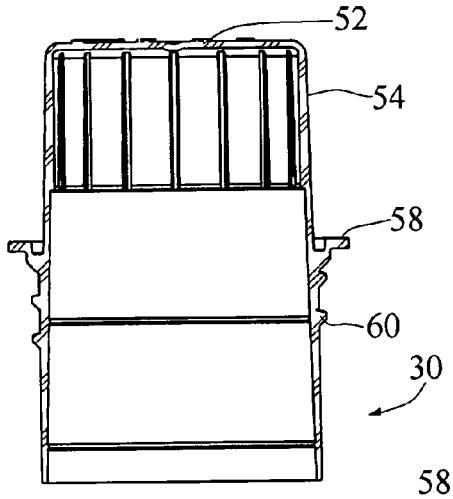
FIG. 4 is a sectional view taken along line IV—IV of FIG. 5 of a closure for the snap on drain back pour spout fitment of FIG. 1 according to the present invention.
Figure 6:
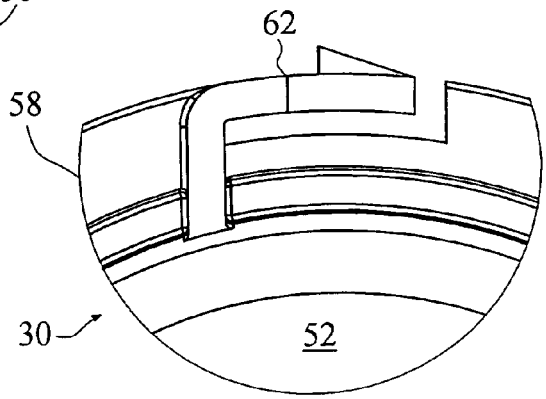
FIG. 6 is an enlarged view of the child safety latch of the closure of FIGS. 4–5 for engaging the recess in the fitment of FIG. 3.
Figure 5:
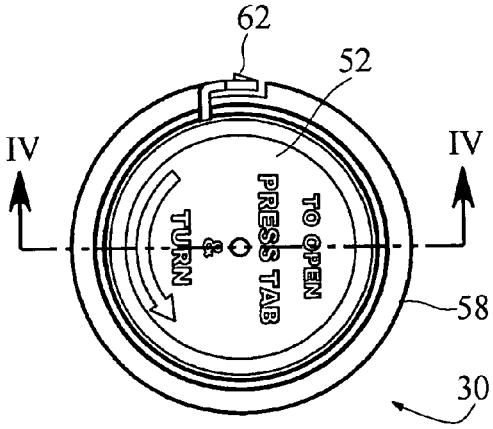
FIG. 5 is a top plan view of the closure of FIG. 4 for the drain back pour spout fitment illustrated in FIG. 1.

The closure 30 is illustrated in detail in FIGS. 4–6. The closure 30 is a one piece injection molded polypropylene component. The closure 30 is a closed end cap structure with a top 52 and annular side wall 54 extending down from the top 52. The closure 30 has a plug seal 56 and outer flange 58 above external threads 60, with the plug seal 56 engaging the upper flange 34 of the fitment 20 when in a closed position. The closure 30 will encompass the spout 42 and be threaded onto the fitment 20 to engage the seal 56 against the flange 34. Further, the closure 30 has a radial outwardly facing cantilevered latch 62 extending from the outer flange 58, with the latch 62 engaging the radial inwardly facing projection 46 on the fitment 20 forming the other half of the child safety feature for the fitment closure 10.

In operation the closure 30 is threaded onto the fitment 20 through the engagement of the threads 38 and 60 until the latch 62 is in locking engagement with the projection 46. The shape of the projection 40 and the latch 62 will provide a tactile and audible "click" when engagement is reached. With the latch 62 engaging the projection 42 the plug seal 56 will be in sealing engagement with the flange 34 closing the fitment closure 10. In removing the closure 30 from the fitment 20 the user depresses the latch 62 pressing the latch radial inwardly to disengage the latch 62 from the projection 46 and allow the unthreading of the closure 20. This instruction can be molded onto the top 52 of the closure 20 as shown in FIG. 5.

The child safety feature of the invention may be altered within the scope of the present invention, such as making the projection 46 into a recess that receives the latch 62. Opposed latches 62 may be provided as another alternative. However it is preferred that the child safety feature be released by pressing radially inward on the element of the closure 20.

The above described embodiment is intended to be merely illustrative of the present invention and not restrictive thereof. The scope of the present invention is intended to be defined by the appended claims and equivalents thereof.

What is claimed is:

1. A fitment closure comprising:

a drain back pour spout fitment with a snap fit structure overlaying a container or bottle neck finish, wherein the snap fit structure has an outer annular skirt with internal, radial inwardly facing beads engaging a radial outwardly facing surface of the bottle finish, the fitment including a horizontal upper flange extending inwardly from the outer annular skirt, the fitment including an inner annular skirt extending from the flange with internal threads on the inner annular skirt, the fitment including a lower apron with a drain back opening in a lowermost portion thereof, the fitment including a pour spout extending from the apron, and the fitment including a radial inwardly facing interfering projection; and a closure removable from to the fitment, the closure having a plug seal engaging the upper flange of the fitment when the closure is attached to the fitment, external threads that engage the internal threads of the inner annular skirt to secure the closure to the fitment, and the closure including a radial outwardly facing latch releasably engaging the radial inwardly facing interfering projection on the fitment thereby forming a child safety feature for the closure.

2. The fitment closure of claim 1 wherein the fitment is a one piece injection molded polypropylene component.

3. The fitment closure of claim 1 wherein the closure is a one piece injection molded polypropylene component.

4. The fitment closure of claim 1 wherein the closure includes a radial outwardly extending flange extending from the plug seal.

5. The fitment closure of claim 4 wherein the plug seal has an outer beveled edge extending toward the outwardly extending flange.

6. The fitment closure of claim 4 wherein the latch is a cantilever structure extending from the outwardly extending flange.

7. The fitment closure of claim 1 wherein only one latch and one projection form the child safety feature for the fitment closure.

8. The fitment of claim 1 wherein the cap includes indicia indicative of removal of the cap.

9. The fitment of claim 1 wherein the spout has an open side aligned with the opening in the apron.

10. The fitment of claim 9 wherein the open side of the spout widens near the top of the spout.

11. The fitment of claim 1 wherein the closure has a top and an annular side wall extending from the top, with the threads of the closure formed on the side wall and the side wall extending substantially beyond the threads.

* * * * *